US009925434B2

(12) United States Patent
Solheim et al.

(10) Patent No.: US 9,925,434 B2
(45) **Date of Patent: *Mar. 27, 2018**

(54) GOLF CLUB HEAD AND METHOD OF MANUFACTURING GOLF CLUB HEAD

(71) Applicant: Karsten Manufacturing Corporation, Phoenix, AZ (US)

(72) Inventors: John A. Solheim, Phoenix, AZ (US); Michael R. Nicolette, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/482,282

(22) Filed: Apr. 7, 2017

(65) Prior Publication Data

US 2017/0209756 A1 Jul. 27, 2017

Related U.S. Application Data

(63) Continuation of application No. 14/707,321, filed on May 8, 2015, now Pat. No. 9,649,543, which is a continuation of application No. 13/437,781, filed on Apr. 2, 2012, now Pat. No. 9,033,812.

(60) Provisional application No. 61/525,654, filed on Aug. 19, 2011, provisional application No. 61/471,046, filed on Apr. 1, 2011.

(51) Int. Cl.

| | |
|---|---|
| ***A63B 69/36*** | (2006.01) |
| ***A63B 53/00*** | (2015.01) |
| ***A63B 53/04*** | (2015.01) |

(52) U.S. Cl.
CPC .. *A63B 53/0487* (2013.01); *A63B 2053/0437* (2013.01); *A63B 2053/0441* (2013.01)

(58) Field of Classification Search
CPC ..... A63B 53/0487; A63B 2053/0437; A63B 2053/0441
USPC ..... 473/324–350, 287–292, 251–256
See application file for complete search history.

(56) References Cited

U.S. PATENT DOCUMENTS

| | | | |
|---|---|---|---|
| D203,512 | S | 1/1966 | Solheim |
| D207,227 | S | 3/1967 | Solheim |
| D207,228 | S | 3/1967 | Soheim |
| D213,509 | S | 3/1969 | Solheim |
| D239,951 | S | 5/1976 | Carrier |
| 4,077,633 | A | 3/1978 | Studen |
| D263,614 | S | 3/1982 | Solheim |
| 4,508,350 | A | 4/1985 | Duclos |
| D283,039 | S | 3/1986 | Solheim |
| D290,984 | S | 7/1987 | Antonious |
| D291,106 | S | 7/1987 | Antonious |
| 4,693,478 | A | 9/1987 | Long |
| D313,451 | S | 1/1991 | Shearer |
| D315,005 | S | 2/1991 | Solheim |
| D322,648 | S | 12/1991 | Antonious |

(Continued)

*Primary Examiner* — Sebastiano Passaniti

(57) ABSTRACT

A putter-type golf club head and method of manufacturing said golf club are herein disclosed. The putter has a body, a face surface, a rear surface, a sole surface, a crown surface, and a heel surface. To reduce the reflective glare off the crown surface and to improve the ease of alignment, the putter includes various curved boundaries between surfaces of the club head. Multiple sections of the crown connect with the heel surface through curved transition regions, which reflect the light differently than the crown surface and thus serve as alignment aids.

20 Claims, 14 Drawing Sheets

(56) References Cited

U.S. PATENT DOCUMENTS

| | | | |
|---|---|---|---|
| 5,078,398 | A | 1/1992 | Reed et al. |
| D329,480 | S | 9/1992 | Antonious |
| 5,292,128 | A | 3/1994 | Solheim |
| D356,615 | S | 3/1995 | Solheim |
| D357,291 | S | 4/1995 | Solheim |
| D367,905 | S | 3/1996 | Kanazawa |
| D380,245 | S | 6/1997 | Meyer |
| D380,246 | S | 6/1997 | Solheim et al. |
| D388,485 | S | 12/1997 | Morgan et al. |
| D401,651 | S | 11/1998 | Cleveland et al. |
| D402,343 | S | 12/1998 | Helmstetter et al. |
| D408,066 | S | 4/1999 | Gurrola |
| D410,267 | S | 5/1999 | Solheim et al. |
| D428,086 | S | 7/2000 | Solheim |
| D429,297 | S | 8/2000 | Hettinger |
| D430,633 | S | 9/2000 | Billings |
| D438,272 | S | 2/2001 | Moore |
| 6,261,190 | B1 | 7/2001 | Ashcraft |
| D449,085 | S | 10/2001 | Breier et al. |
| D459,423 | S | 6/2002 | Long |
| 6,450,894 | B1 | 9/2002 | Sun et al. |
| 6,743,112 | B2 | 6/2004 | Nelson |
| D498,276 | S | 11/2004 | Schweigert et al. |
| D524,887 | S | 7/2006 | Jones et al. |
| D525,328 | S | 7/2006 | Solheim et al. |
| D548,294 | S | 8/2007 | Nguyen et al. |
| 7,255,650 | B2 | 8/2007 | Bryant |
| D559,928 | S | 1/2008 | Cameron |
| 7,364,514 | B2 | 4/2008 | Yamaguchi et al. |
| 7,390,267 | B2 | 6/2008 | Grace |
| 7,452,283 | B2 | 11/2008 | Hettinger et al. |
| D583,887 | S | 12/2008 | Cameron |
| D590,462 | S | 4/2009 | Hettinger et al. |
| D650,455 | S | 12/2011 | Serrano et al. |
| 9,033,812 | B2 | 5/2015 | Solheim |
| 9,649,543 | B2 * | 5/2017 | Solheim ..... A63B 53/0487 |
| 2003/0207724 | A1 | 11/2003 | Cameron et al. |
| 2005/0020381 | A1 | 1/2005 | Yamaguchi et al. |
| 2005/0037854 | A1 | 2/2005 | Green |
| 2007/0265110 | A1 | 11/2007 | Schweigert et al. |
| 2010/0120548 | A1 | 5/2010 | Bittner |
| 2012/0077615 | A1 | 3/2012 | Schmidt |

* cited by examiner

900

100

GOLF CLUB HEAD AND METHOD OF MANUFACTURING GOLF CLUB HEAD

CROSS-REFERENCE TO RELATED APPLICATIONS

This is a continuation of U.S. patent application Ser. No. 14/707,321, filed May 8, 2015, which is a continuation of U.S. patent application Ser. No. 13/437,781, filed Apr. 2, 2012, now U.S. Pat. No. 9,033,812, which claims the benefit of U.S. Provisional Application No. 61/525,654 filed Aug. 19, 2011, and U.S. Provisional Application No. 61/471,046, filed Apr. 1, 2011, the contents of each of these disclosures above are incorporated fully herein by reference.

TECHNICAL FIELD

This present disclosure relates generally to golf clubs, and relates more particularly to golf club putters and methods of manufacturing the same.

DESCRIPTION OF THE BACKGROUND

Golf clubs have edges that create the general shape of the golf club. Usually some of these edges are made smoother and cleaner by using radii of curvature at these edges instead of using hard or sharp ninety-degree edges. For lower cost and ease of manufacturing, the radius of curvature of each particular curved edge of a golf club head is constant and unchanging.

An accurate putting stroke is accomplished through various subjective (e.g., sound and aesthetics), as well as objective, features (e.g., high moment of inertia (MOI), and straight swing plane). A golf putter center alignment aid often has to help a person align the golf putter to a golf ball and a golf hole. Other visual lines on the golf putter, however, can clutter the view of the person and distract the person from the alignment process. For example, skewed or angled edges of the golf club head, the radii of curvature, creases, paint, and even shadows created by skewed edges on the golf putter can distract the person and decrease the accuracy of the person's putting stroke.

BRIEF DESCRIPTION OF THE DRAWINGS

To facilitate further description of the embodiments, the following drawings are provided in which.

Figure 2:
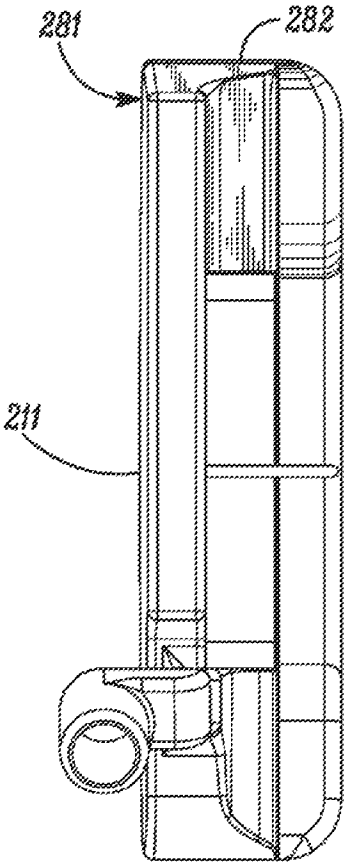
PRIOR ART FIG. 2
FIG. 2 illustrates a top view of a portion of a prior art golf club.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, electrically, mechanically and/or otherwise. For example, two or more mechanical elements may be mechanically coupled, but not be electrically or otherwise coupled. Coupling may be for any length of time, e.g., permanent or semi-permanent or only for an instant.

DETAILED DESCRIPTION OF EXAMPLES OF EMBODIMENTS

In a number of embodiments, a golf club includes: a golf club head body having: a face member arranged for impacting a golf ball; a sole; a toe edge coupled to the face member and the sole; a first surface located opposite the sole and coupled to a first portion of the toe edge; and a second surface located opposite the sole and coupled to a second portion the toe edge. A first distance between the first surface and a ground plane can be greater than a second distance between the second surface and the ground plane. The second surface is not parallel to the ground plane when the golf club head body is at an address position. A radius of curvature of the toe edge is not constant. The radius of curvature of the toe edge varies at the second portion of the toe edge such that the first portion and the second portion of the toe edge form a first alignment aid for the golf club.

In other examples, a golf club putter can include: a strike surface; a sole coupled to the strike surface; a first edge coupled to the sole and the strike surface; a first surface opposite the sole and coupled to the first edge at a first boundary; and a second surface opposite the sole and coupled to the first edge at the first boundary. The first surface is non-coplanar with the second surface. The first boundary has a radius of curvature that is variable such that the first boundary is substantially perpendicular to the strike surface.

In yet another embodiment, a method for manufacturing a golf club can include: providing a golf club head body having a face member, a sole, a toe edge coupled to the face member and the sole, a first surface coupled to a first portion of the toe edge, and a second surface coupled to a second portion the toe edge; and removing a part of the second portion of the toe edge such that a radius of curvature of the toe edge varies at the second portion such that the first portion and the second portion of the toe edge form a first alignment aid for the golf club.

In additional embodiments, a golf club head can include: a face surface for striking a ball; a sole coupled to the face surface; a first surface located opposite the sole and coupled to the face surface; a second surface coupled to the first surface; and a first edge coupled to the sole, the first edge is further coupled to the first and second surfaces at a first boundary, the first edge can include: a first part coupled to the first surface at the first boundary; and a second part coupled to the second surface at the first boundary, the second part is coupled to the first part of the first edge at a second boundary. The first boundary forms an alignment aid for the golf club head. The second part of the first edge has a variable radius of curvature. An alignment plane is substantially perpendicular to the face surface and substantially parallel to a ground plane. A first projection is a projection into the alignment plane of the first boundary. A second projection is a projection into the alignment plane of the second boundary. A third projection is a projection into the alignment plane of a line coupling the first boundary to the second boundary. The first projection intersects the second projection at a first intersection point in the alignment plane. The first projection and the second projection forms an angle $\theta$ in the alignment place at the first intersection point. A first length, a, is measured in the alignment place along the first projection from the first intersection point to an intersection with the third projection. A variable width, r, of the third projection is defined by $r=a*\tan(\theta)$. The variable width is a width of the second part of the first edge.

Figure 1:
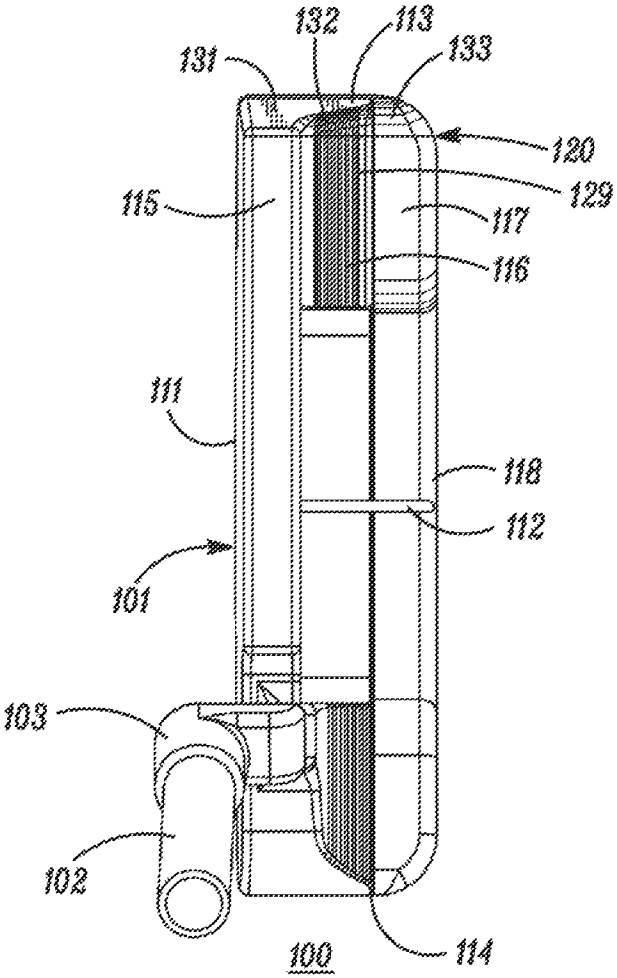
FIG. 1 illustrates a top view of a portion of a golf club, according to a first embodiment.
Figure 3:
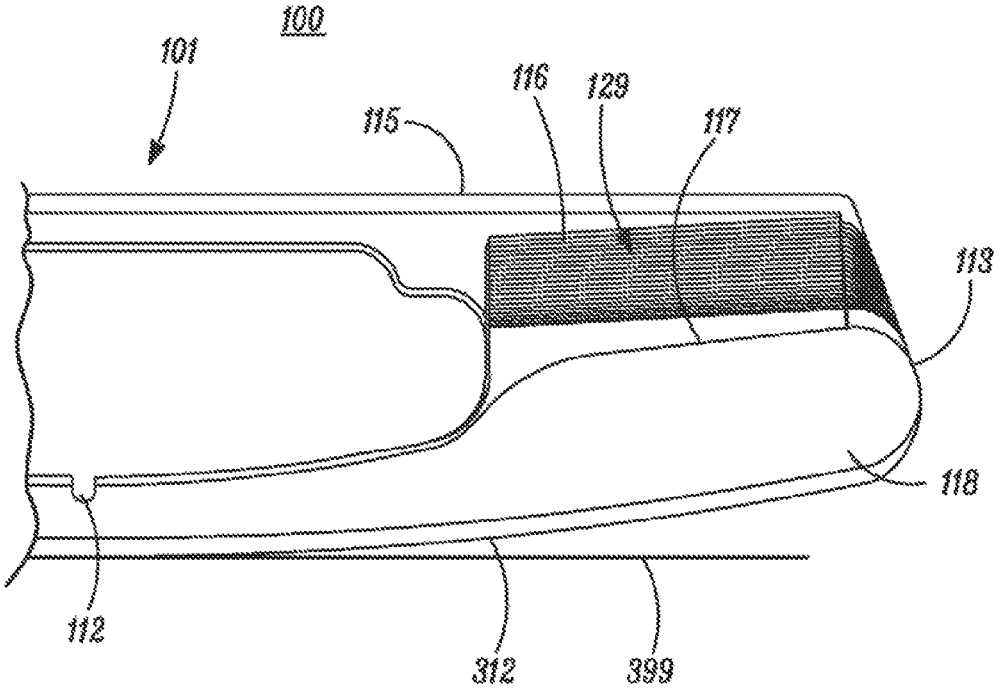
FIG. 3 illustrates a back, toe-side view of a first part of a golf club head body of the golf club of FIG. 1, according to the first embodiment.
Figure 4:
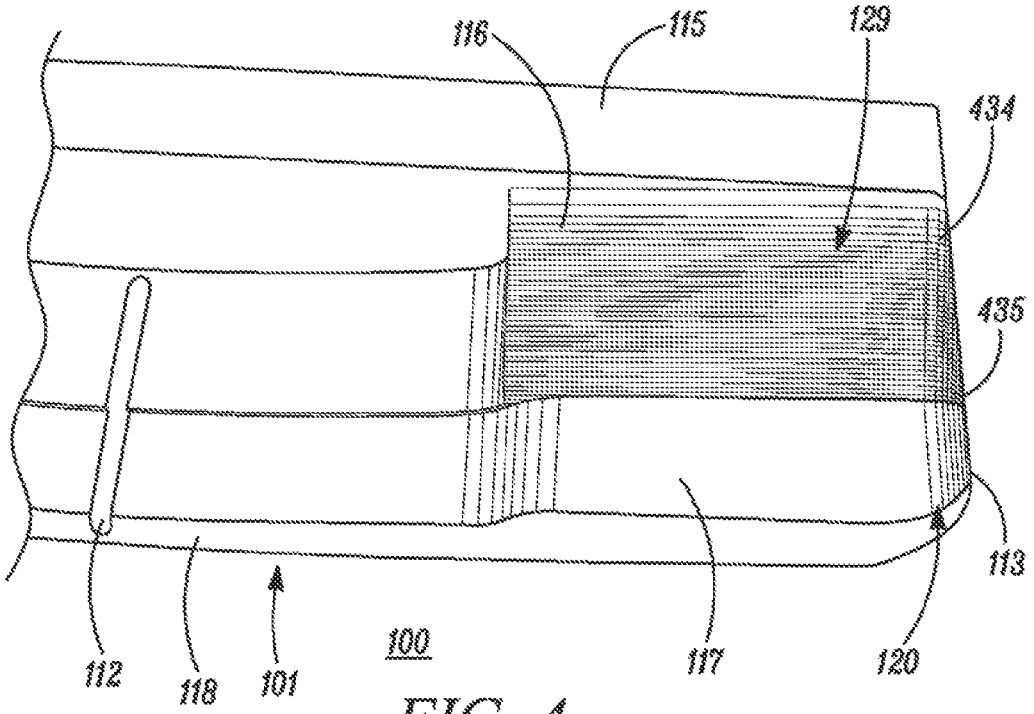
FIG. 4 illustrates a top, back, toe-side view of the first part of the golf club head body of FIG. 1, according to the first embodiment.
Figure 5:
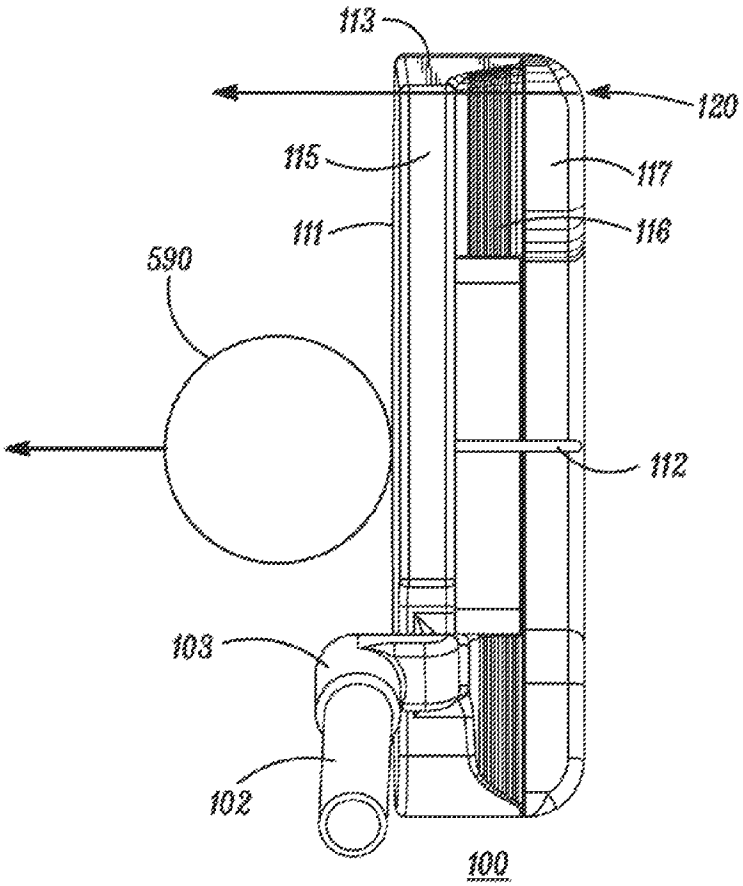
FIG. 5 illustrates an annotated top view of the golf club of FIG. 1 and a golf ball, according to the first embodiment.
Figure 7:
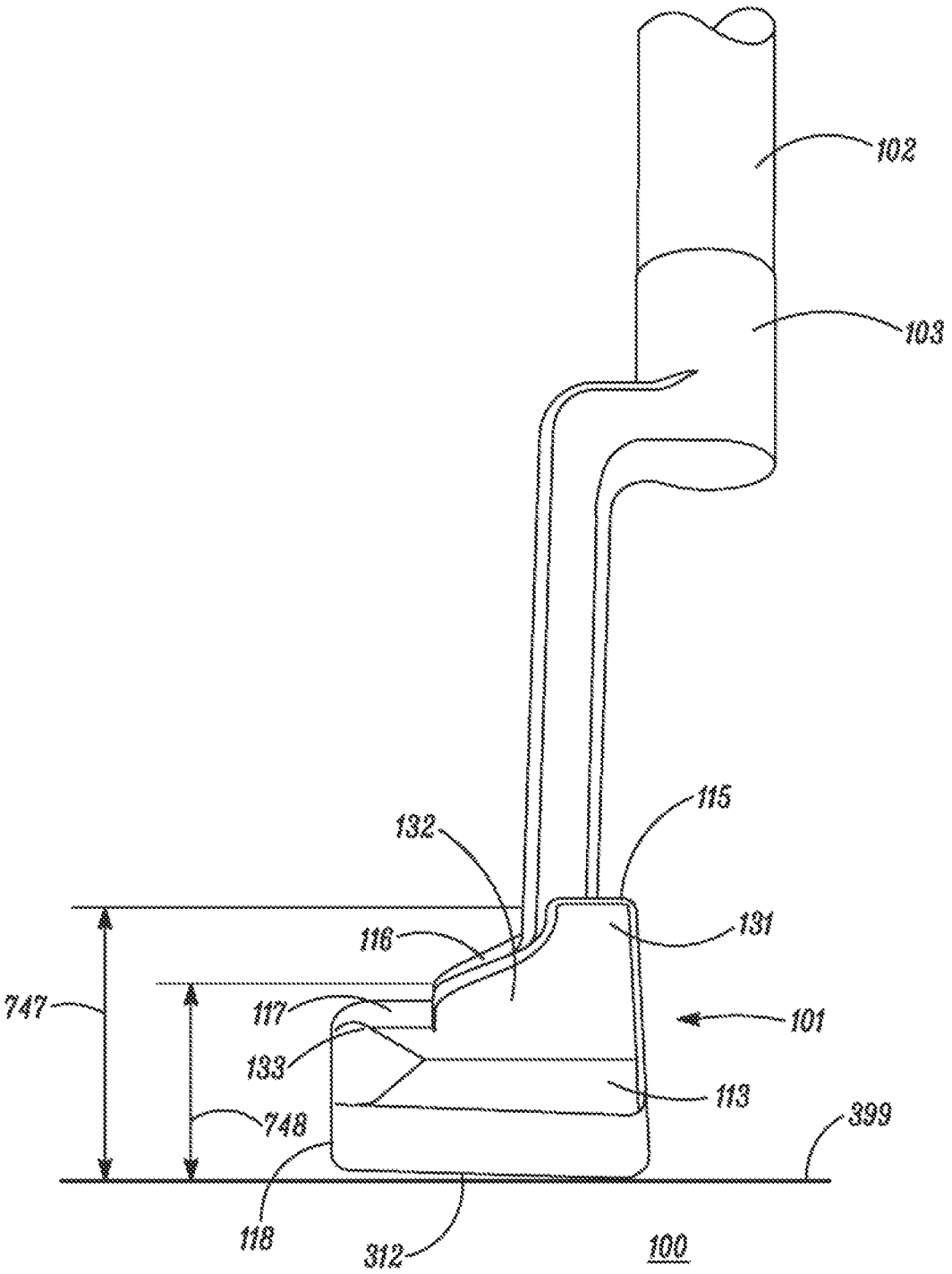
FIG. 7 illustrates a side view of the toe end of the golf club head body of FIG. 1, according to the first embodiment.
Figure 12:
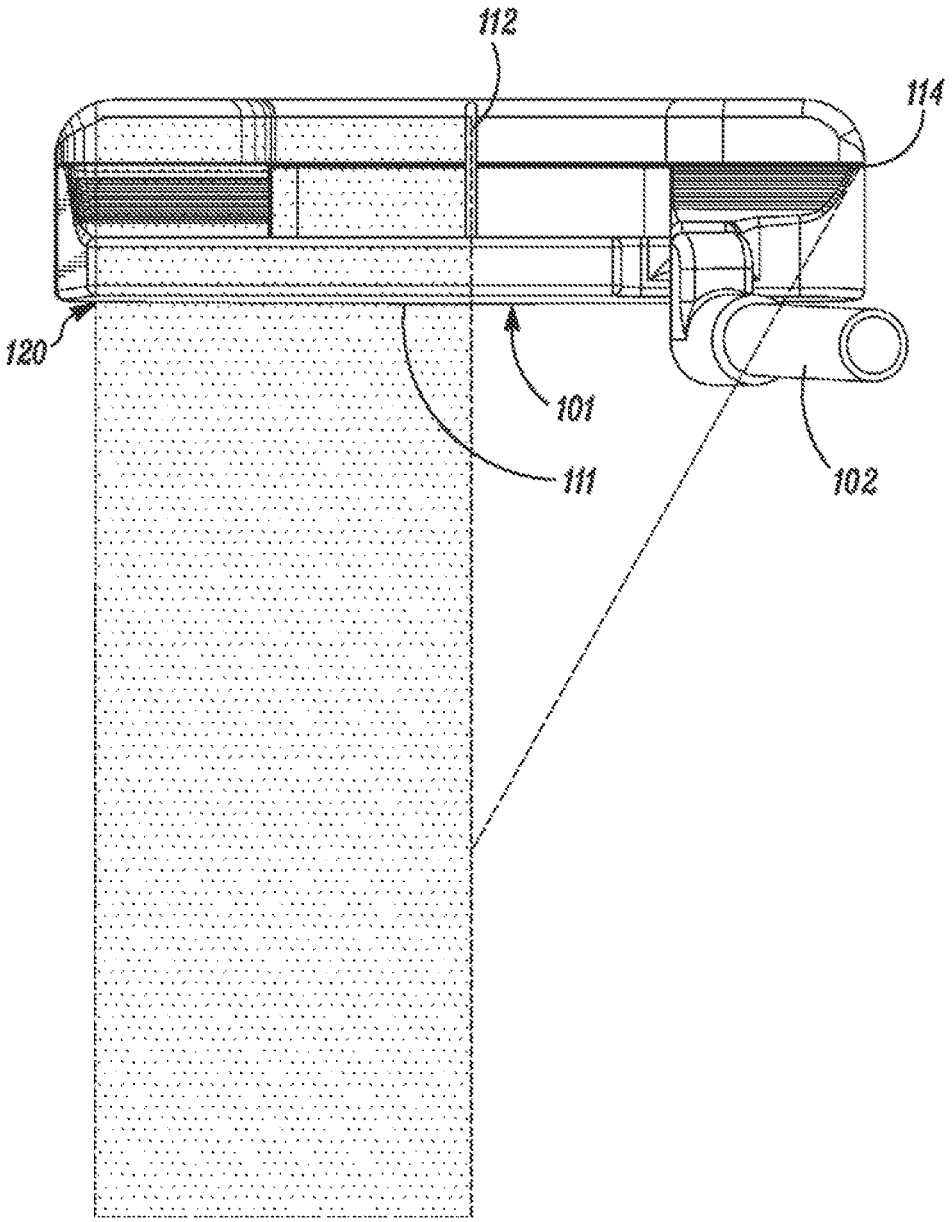
FIG. 12 illustrates another annotated top view of the golf club of FIG. 1, according to the first embodiment.

Turning to the drawings, FIG. 1 illustrates a top view of a portion of a golf club 100, according to a first embodiment. FIG. 3 illustrates a back, toe-side view of a first part of a golf club head body 101 of golf club 100, according to the first embodiment. FIG. 4 illustrates a top, back, toe-side view of the first part of golf club head body 101 of golf club 100, according to the first embodiment. FIG. 5 illustrates an annotated top view of golf club 100 and a golf ball 590, according to the first embodiment. FIG. 7 illustrates a side view of a toe end of golf club head body 101, according to the first embodiment. FIG. 12 illustrates an annotated top view of golf club 100, according to the first embodiment.

Golf club 100 is merely exemplary and is not limited to the embodiments presented herein. Golf club 100 can be employed in many different embodiments or examples not specifically depicted or described herein. Golf club 100 can be an iron-type golf club head, such as a 1-iron, a 2-iron, a 3-iron, a 4-iron, a 5-iron, a 6-iron, a 7-iron, an 8-iron, a 9-iron, a sand wedge, a lob wedge, a pitching wedge, an n-degree wedge (e.g., 44 degrees (°), 48°, 52°, 56°, 60°, etc.), etc. In a different embodiment, golf club 100 can also be a wood-type golf club, a hybrid-type golf club, or a putter-type golf club. In addition to the specific embodiments and examples shown and described herein, putter heads commonly referred to as blades, mallet putters, Anser® putters, or any other type of putter head that may be used in accordance with the present description may be used (whether currently existing or discovered hereafter).

In some embodiments, golf club 100 can include: (a) golf club head body 101; (b) a shaft 102; and (c) a hosel 103 coupled to shaft 102. In a different embodiment, golf club 100 has a hole, instead of hosel 103, to which shaft 102 is coupled. A first end of shaft 102 and hosel 103 may be secured to each other by an adhesive bonding process (e.g., epoxy) and/or other suitable bonding processes (e.g., mechanical bonding, soldering, welding, and/or brazing). To complete the golf putter, a grip (not shown) may receive a second or opposite end of the shaft. The shaft and the grip may be secured to each other by an adhesive bonding process and/or other suitable bonding processes. Hosel 103 or the hole can be at the heel end of golf club head body 101 or at a center of golf club head body 101.

Golf club head body 101 includes: (a) a face member 111 (i.e., a strike surface) arranged for impacting a golf ball 590 (FIG. 5); (b) a sole 312 (FIG. 3) coupled to face member 111; (c) a toe edge 113 coupled to face member 111 and sole 312; (d) a heel edge 114 opposite toe edge 113 and coupled to face member 111 and sole 312; (e) a first surface (e.g., a "top surface") 115 coupled to toe edge 113 at a boundary 120; (f) a second surface 116 coupled to toe edge 113 at boundary 120; (g) a third surface 117 coupled to toe edge 113 at boundary 120; and (h) a rear surface 118 opposite face member 111. Face member 111 is located closer to first surface 115 than second surface 116, and face member 111 is located closer to second surface 116 than third surface 117.

In some examples, golf club head body 101 can be manufactured from a steel material, another metal, or one or more other materials by a casting process, a forging process, a combination thereof, or one or more other suitable manufacturing processes. In many examples, golf club head body 101 can be formed as a unitary body, or face member 111 can be a separate piece from the rest of golf club head body 101. In addition to the alignment aids that will be discussed below, golf club head body 101 can include one or more alignment lines or marks 112, which are visible when viewing golf club head body 101 from above and/or at the address position.

In various embodiments, first surface 115 can be adjacent to second surface 116 and located apart from third surface 117. Second surface 116 can be adjacent to first surface 115 and third surface 117. In some examples, second surface 116 can include one or more ridges 129. Without ridges 129, second surface 116 could be a reflective surface that can reflect light into a person's eyes when the person is looking down at golf club head body 101 at an address position. Ridges 129 change the angle of reflection of at least part of the light hitting second surface 116. Accordingly, second surface 116 with ridges 129 does not reflect a substantial amount of light into the person's eyes when the person is looking down at golf club head body 101 before hitting golf ball 590 (FIG. 5). In other embodiments, first surface 115, third surface 117, and/or other portions of golf club head body 101 can have similar ridges.

In other embodiments, golf club 100 can have only first surface 115 and second surface 116 as the top surfaces. In still other embodiments, golf club 100 can have a single surface as the top surface, or can have first surface 115, second surface 116, third surface 117, and one or more fourth surfaces as the top surfaces.

In some examples, first surface 115 can be coupled to toe edge 113 at a first portion 131 (FIGS. 1 and 7) of toe edge 113. Second surface 116 can be coupled to toe edge 113 at a second portion 132 of toe edge 113. Third surface 117 can be coupled to toe edge 113 at a third portion 133 of toe edge 113. First portion 131, second portion 132, and third portion 133 can be part of or form boundary 120.

In many examples, toe edge 113 can have a variable radius of curvature such that boundary 120 (and/or first portion 131, second portion 132, and/or third portion 133) can form an alignment aid for the person using golf club 100. For example, as shown in FIG. 5, boundary 120 can be perpendicular to face member 111. In the same or different embodiments, boundary 120 can be a sheen line of golf club head body 101.

Using a variable radius at toe edge 113 allows the golf club manufacturer to make toe edge 113 substantially perpendicular, or appear to be substantially perpendicular, to face member 111, instead of being skewed at an angle. FIG. 5 illustrates the line created by boundary 120 and the proper alignment of golf ball 590 with golf club 100. FIG. 12 illustrates another view of the visual impression created by alignment mark 112 and the line created by boundary 120. As shown in FIGS. 5 and 12, the variable radius of toe edge 113 creates a line that is parallel to the proper alignment of golf club 100 and golf ball 590 (FIG. 5) and that is substantially perpendicular to face member 111. The variable radius of toe edge 113 helps in the alignment of golf club 100 and golf ball 590 with the desired path of golf ball 590. In many embodiments, the line created by boundary 120 is parallel with alignment mark 112. Boundary 120 and alignment mark 112 together can create a visual impression for the golf club user of the proper alignment of golf club 100. Moreover, in some examples, boundary 120 is substantially perpendicular to the face member 111, and its perpendicular configuration will be apparent to the user of golf club 100 because golf ball 590 will take a substantially perpendicular path to face member 111 when golf ball 590 is properly struck.

Figure 6:
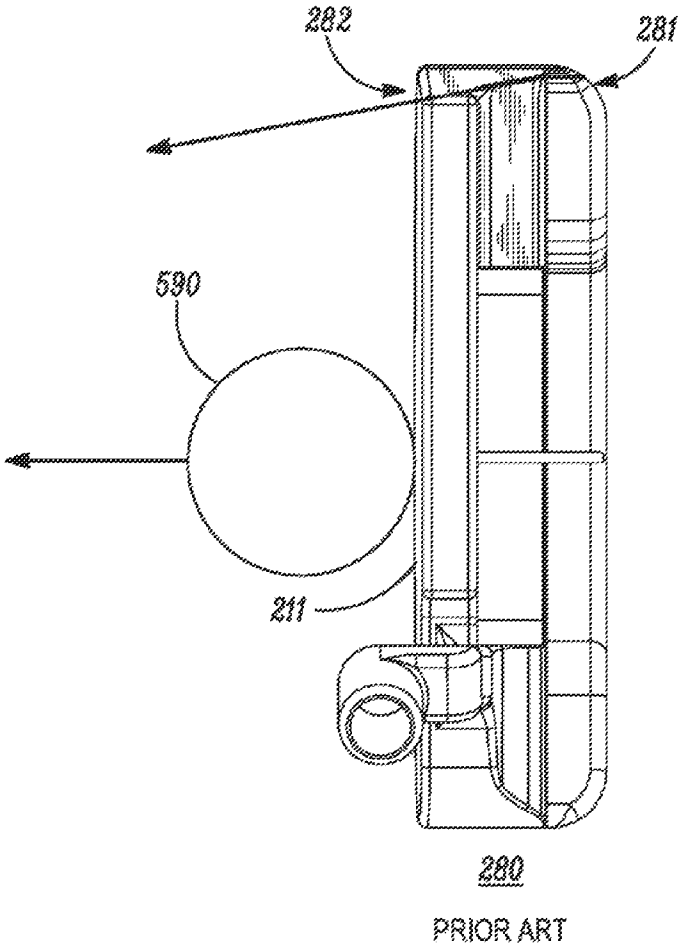
PRIOR ART FIG. 6
FIG. 6 illustrates an annotated top view of the prior art golf club of FIG. 2 and the golf ball of FIG. 5.
Figure 11:
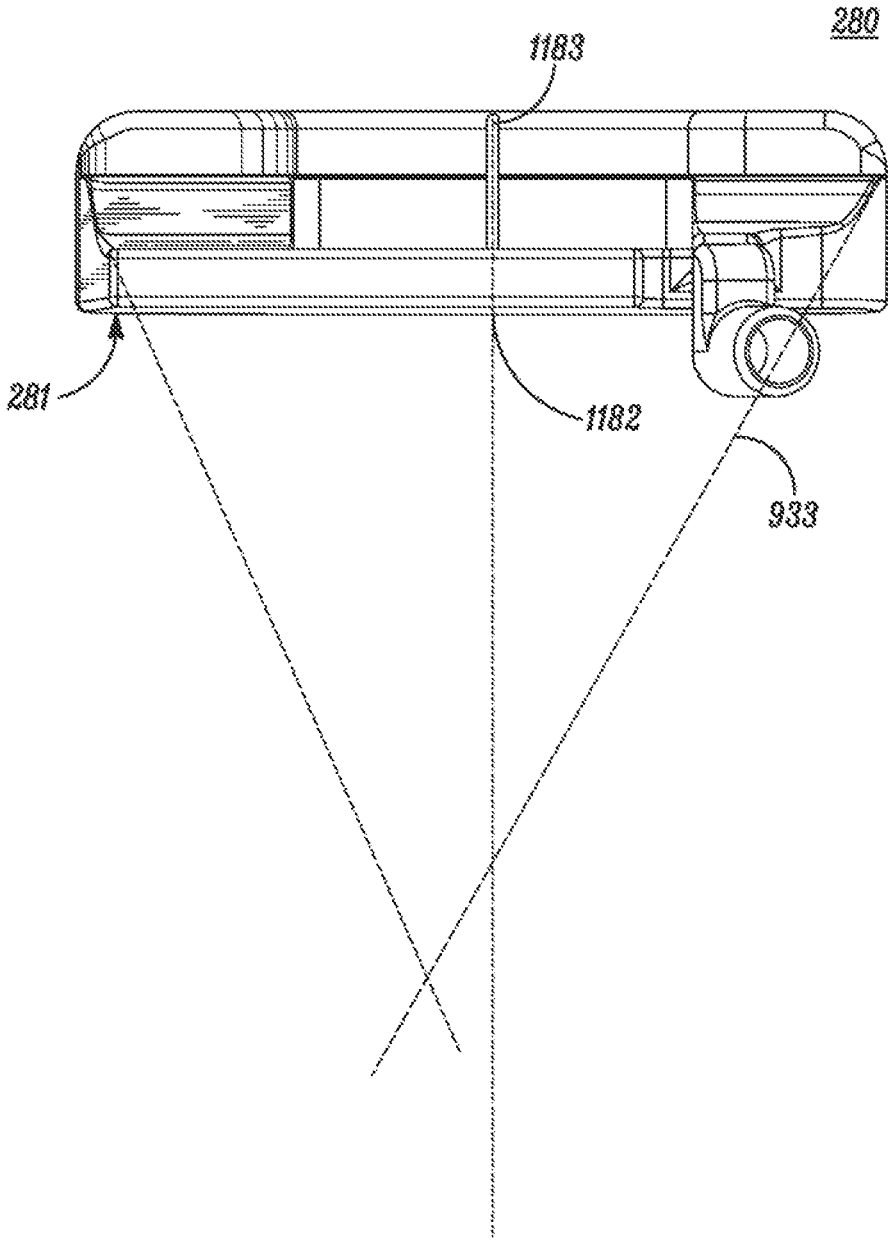
PRIOR ART FIG. 11
FIG. 11 illustrates an annotated top view of the prior art golf club of FIG. 2.

For comparison, FIGS. 2, 6, and 11 illustrate a prior art golf club head 280 with a boundary 281 of toe edge 282. Toe edge 282 does not have a variable radius at boundary 281. Rather, the radius of toe edge 282 is constant. As shown in FIGS. 2 and 6, the constant radius of toe edge 282 creates a line at boundary 281 that is at least partially skewed at an angle in relation to face member 211 of golf club head 280. This skewed boundary 281 can create a distraction to the person using golf club head 280 by creating lines that may cause the person using the golf club to misalign golf club 200 with golf ball 590 (FIG. 6).

As shown in FIG. 11, prior art golf club head 280 also can have a skewed boundary 1182 at a heel portion, in addition to skewed boundary 281 at a toe portion, and alignment lines or marks 1183 in a center portion. Skewed boundary 281 along with skewed boundary 1182 and alignment marks 1183 can create confusing and misaligned visual lines that are a distraction to the user of golf club head 280.

On the other hand, as shown in FIGS. 1, 5, and 12, boundary 120 of golf club 100 keeps the user's view of golf club 100 clean and less cluttered, while also acting as a complimentary alignment tool, which can give the user more confidence and allow for a better shot. By comparison, toe edge 282 and boundary 281 of golf club head 280 (FIGS. 2 and 6) are not concerned with complementing or confirming the user's alignment. By adding the variable radius to toe edge 113 of golf club 100, the effectiveness of golf club 100 can be greatly increased, with comparatively low additional cost and comparatively low added manufacturing complexity.

Referring again to FIGS. 1, 3-5, 7, and 12, toe edge 113 can have a radius of curvature that varies in second portion 132 such that first portion 131 and second portion 132 form the alignment aid for the person using the golf club. In the same or different example, toe edge 113 also can have a radius of curvature that varies between first portion 131, second portion 132, and third portion 133 such that all three portions form the alignment aid.

In many embodiments, the radius of curvature of the toe portion continuously varies in second portion 132. In the same or different embodiments, the radius of curvature is constant in first portion 131 and third portion 133. In other examples, the radius of curvature of toe edge 113 varies in two or more of first portion 131, second portion 132, and third portion 133. In other examples, instead of using a continuously varying radius of curvature, a trapezoid or a variable angle can be used in second portion 132.

In some examples, first surface 115 is substantially opposite sole 312. In the same or different embodiments as shown in FIG. 3, first surface 115 can be substantially parallel to a ground plane 399 when golf club head body 101 is at an address position. As shown in FIGS. 1, 3-5, and 7, if first surface 115 is substantially parallel to ground plane 399 at the address position and if boundary 120 at first portion 131 is substantially perpendicular to first surface 115, first portion 131 can have a constant radius of curvature at boundary 120. In other examples, if first surface 115 is not parallel to ground plane 399 at the address position and/or if boundary 120 at the first portion 131 is not perpendicular to first surface 115, first portion 131 can have a variable radius of curvature.

Furthermore, first surface 115 can be adjacent to second surface 116, but first surface can be non-coplanar with second surface 116. In the same or different examples, second surface is not parallel to ground plane 399 when golf club head body 101 is at the address position.

In some examples, as shown in FIG. 7, a first distance 747 between first surface 115 and ground plane 399 is greater than a second distance 748 between second surface 116 and ground plane 399. For example, first distance 747 can be a distance between first surface 115 and ground place 399 at a border 434 (FIG. 4) between first surface 115 and second surface 116, and second distance 748 can be a minimum distance between second surface 116 and ground place 399 at a border 435 (FIG. 4) between second surface 116 and third surface 117. That is, second surface 116 can slope downward from first surface 115 toward third surface 117. In another example, second surface 116 can slope upward from first surface 115 toward third surface 117.

In the examples where second surface 116 slopes downward from first surface 115 toward third surface 117, boundary 120 at second portion 132 can have a variable radius of curvature. The amount of curvature of the radius in second portion 132 can depend on the slope of second surface 116. In some examples, second surface 116 is coupled to toe edge 113 at two or more second points along boundary 120. In some examples, a first radius of curvature at a first point along boundary 120 is different from a second radius of curvature at a second point along boundary 120. In one example, as shown in FIG. 4, the radius of curvature can vary continuously from approximately 5.0 millimeters at border 434 (i.e., the first point) to 2.5 millimeters at border 435 (i.e., the second point).

In various examples, third surface 117 can be parallel, but not coplanar, with first surface 115, as shown in FIG. 7. In the same or different embodiments, third surface 117 can be substantially parallel to ground plane 399 (FIG. 3) when golf club head body 101 is at an address position. Additionally, a distance between third surface 117 and sole 312 (or ground plane 399) is less than the distance between second surface 116 and sole 312 (or ground plane 399).

As shown in FIGS. 1 and 3-5, if third surface 117 is substantially parallel to ground plane 399 at the address position, third portion 133 can have a constant radius of curvature at boundary 120. In other examples, if third surface 117 is not parallel to ground plane 399 at the address position, third portion 133 can have a variable radius of curvature.

Figure 8:
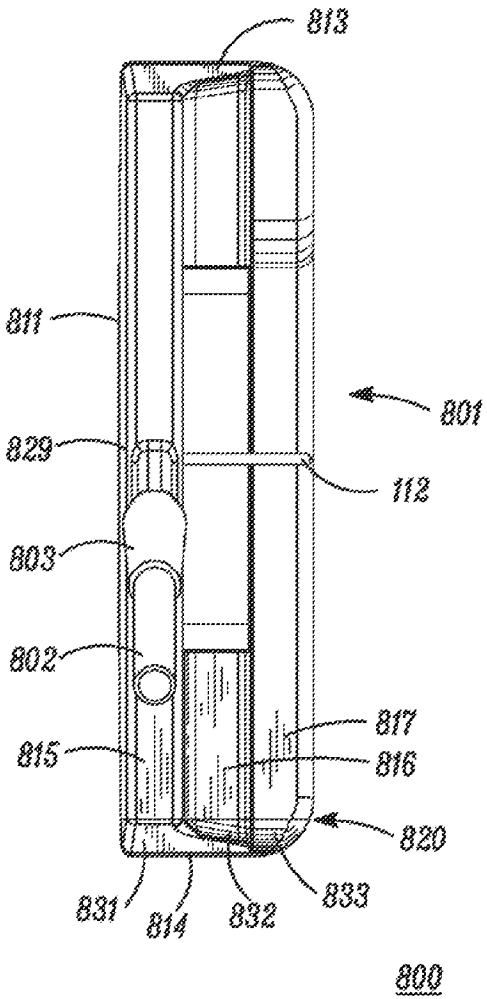
FIG. 8 illustrates a top view of a portion of a golf club, according to a second embodiment.
Figure 13:
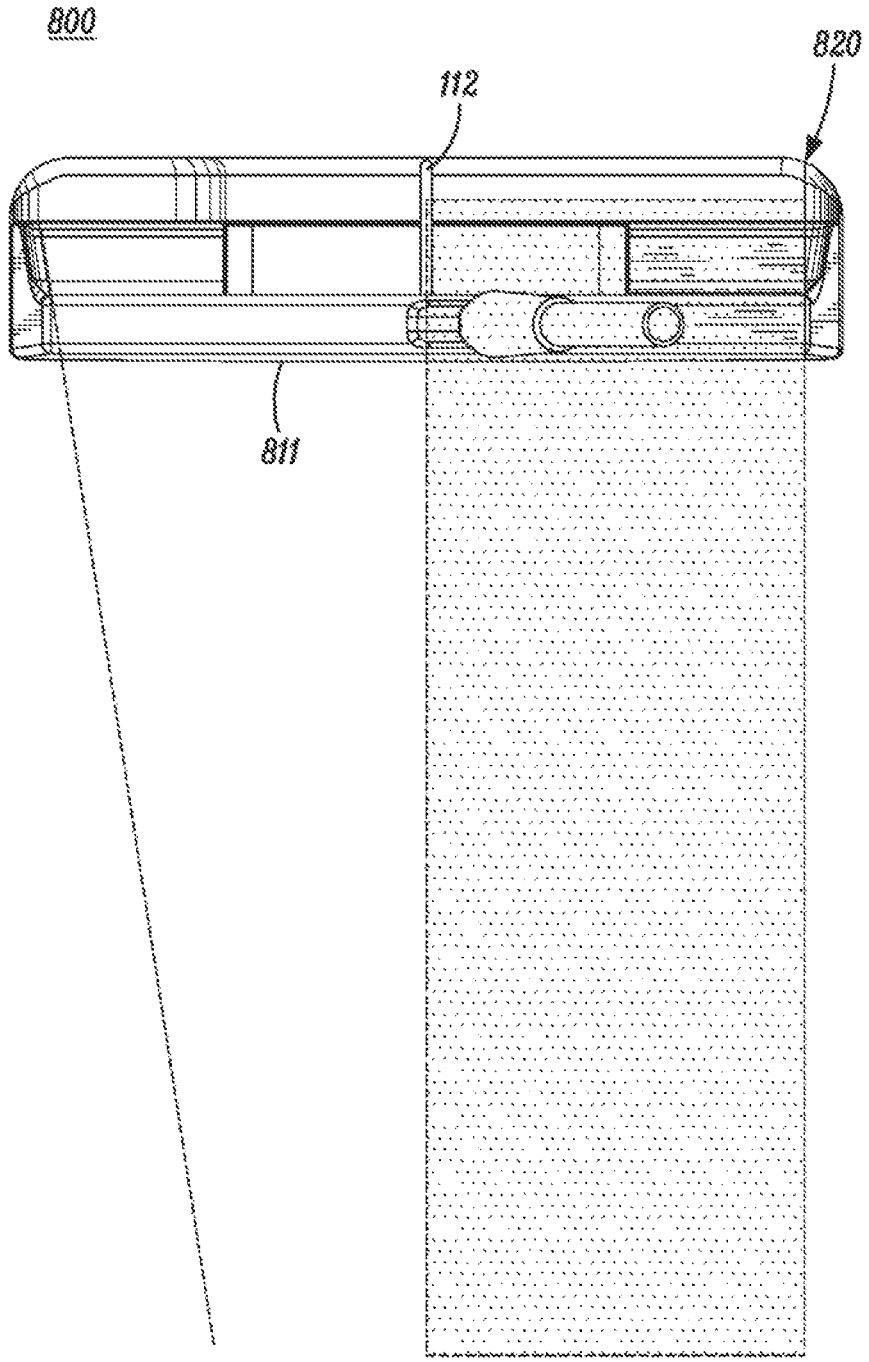
FIG. 13 illustrates an annotated top view of the golf club of FIG. 8, according to the second embodiment.

Turning to another embodiment, FIG. 8 illustrates a top view of a golf club 800, according to a second embodiment. FIG. 13 illustrates an annotated top view of golf club 800, according to the second embodiment. Golf club 800 is merely exemplary and is not limited to the embodiments presented herein. Golf club 800 can be employed in many different embodiments or examples not specifically depicted or described herein. In the illustrated embodiment, the golf club 800 can be similar to golf club 100 in FIGS. 1, 3-5, 7, and 12, except that golf club 800 can have a variable radius of curvature at heel edge 814 similar to the variable radius of curvature of toe edge 113 of golf club 100 of FIGS. 1, 3-5, 7, and 12.

Golf club 800 can be an iron-type golf club head, such as a 1-iron, a 2-iron, a 3-iron, a 4-iron, a 5-iron, a 6-iron, a 7-iron, an 8-iron, a 9-iron, a sand wedge, a lob wedge, a pitching wedge, an n-degree wedge (e.g., 44 degrees (°), 48°, 52°, 56°, 60°, etc.), etc. In a different embodiment, golf club 800 can also be a wood-type golf club, a hybrid-type golf club, or a putter-type golf club.

In some embodiments, a golf club 800 can include: (a) a golf club head body 801; (b) a shaft 802; and (c) a hosel 803 coupled to shaft 802. A first end of shaft 802 and hosel 803 may be secured to each other by an adhesive bonding process (e.g., epoxy) and/or other suitable bonding processes (e.g., mechanical bonding, soldering, welding, and/or brazing). To complete the golf putter, a grip (not shown) may receive a second or opposite end of the shaft. The shaft and the grip may be secured to each other by an adhesive bonding process and/or other suitable bonding processes. In a different embodiment, golf club 800 has a hole, instead of hosel 803, to which shaft 802 is coupled. Hosel 803 or the hole can be at the heel end or at the center portion of golf club head body 801.

Golf club head body 801 includes: (a) a face member 811 (i.e., a strike surface) arranged for impacting a golf ball 590 (FIG. 5); (b) a sole (not shown) coupled to face member 811; (c) a toe edge 813 coupled to face member 811 and the sole of golf club head body 801; (d) a heel edge 814 opposite toe edge 813 and coupled to face member 811 and the sole; (e) a first surface 815 coupled to heel edge 814 at a boundary 820; (f) a second surface 816 coupled to heel edge 814 at boundary 820; (g) a third surface 817 coupled to heel edge 814 at boundary 820. In some examples, golf club head body 101 is configured to couple to hosel 803 at a region 829 substantially midway between toe edge 813 and heel edge 814. In one example, golf club head body 801 may be manufactured from a steel material, steel-based material, or one or more other materials by a process involving casting, forging, cutting, grinding, machining, welding, a combination thereof, or the like.

In some examples, first surface 815 can be coupled to heel edge 814 at a first portion 831 of heel edge 814. Second surface 816 can be coupled to heel edge 814 at a second portion 832 of heel edge 814. Third surface 817 can be coupled to heel edge 814 at a third portion 833 of heel edge 814. First portion 831, second portion 832, and third portion 833 can be part of or form boundary 820. In some examples, one or more of first surface 815, second surface 816, and third surface 917 can have ridges.

In many examples, heel edge 814 can have a variable radius of curvature such that boundary 820 (or first portion 831, second portion 832, and/or third portion 833) forms an alignment aid for person using the golf club. In some embodiments, a radius of curvature of heel edge 814 varies in second portion 832 such that boundary 820 (or first portion 831, second portion 832, and/or third portion 833) forms an alignment aid for the person using golf club 800. For example, as shown in FIG. 8, boundary 820 can be substantially perpendicular to face member 811. In the same or different embodiments, boundary 820 can be a sheen line of golf club head body 801. First portion 831, second portion 832, and third portion 833 can be similar to first portion 131, second portion 132, and third portion 133, respectively, in FIG. 1. Accordingly, boundary 820 can be similar to boundary 120 in FIG. 1.

Using a variable radius of curvature at heel edge 814 allows the golf club manufacturer to make heel edge 814 substantially perpendicular, or appear to be substantially perpendicular, to face member 811, instead of being skewed at an angle. FIG. 13 illustrates the visual impression created by alignment mark 112 and boundary 820. The variable radius of curvature of heel edge 814 creates a line that is substantially parallel to the proper alignment of golf club 800 and golf ball 590 (FIG. 5) and that is substantially perpendicular to face member 811. In many embodiments, a line created by boundary 820 is parallel with alignment mark 112, and together, they can create a visual impression for the golf club user of the proper alignment of golf club 800. Thus, the variable radius of curvature of heel edge 814 helps in the alignment of golf club 800 and golf ball 590 (FIG. 5) with the desired path of golf ball 590 (FIG. 5). Moreover, in some examples, boundary 820 is substantially perpendicular to the face member 811, and its perpendicular nature is apparent to the user of golf club 800 because golf ball 590

(FIG. 5) will take a substantially perpendicular path to face member 811 when golf ball 590 (FIG. 5) is properly struck.

Figure 9:
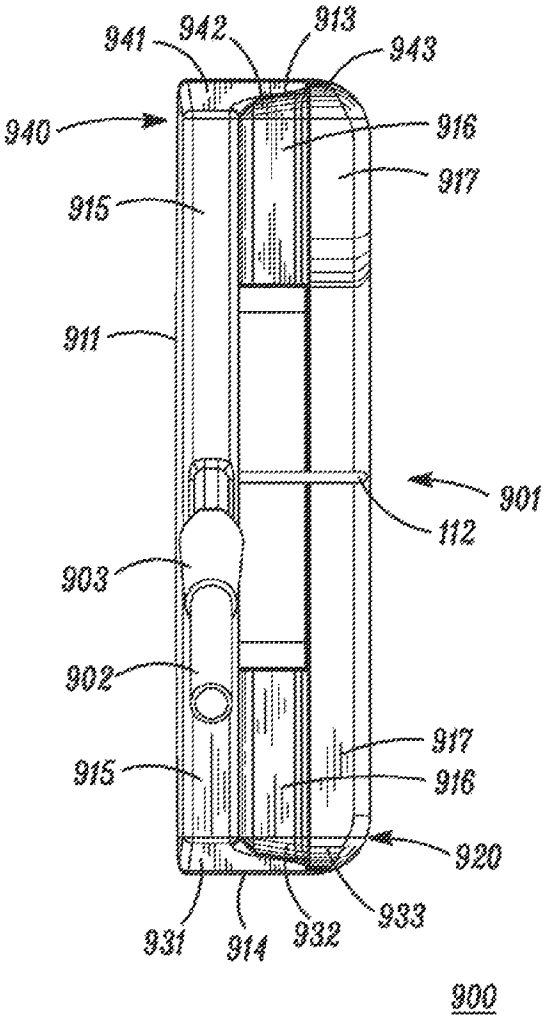
FIG. 9 illustrates a top view of a portion of a golf club, according to a third embodiment.
Figure 10:
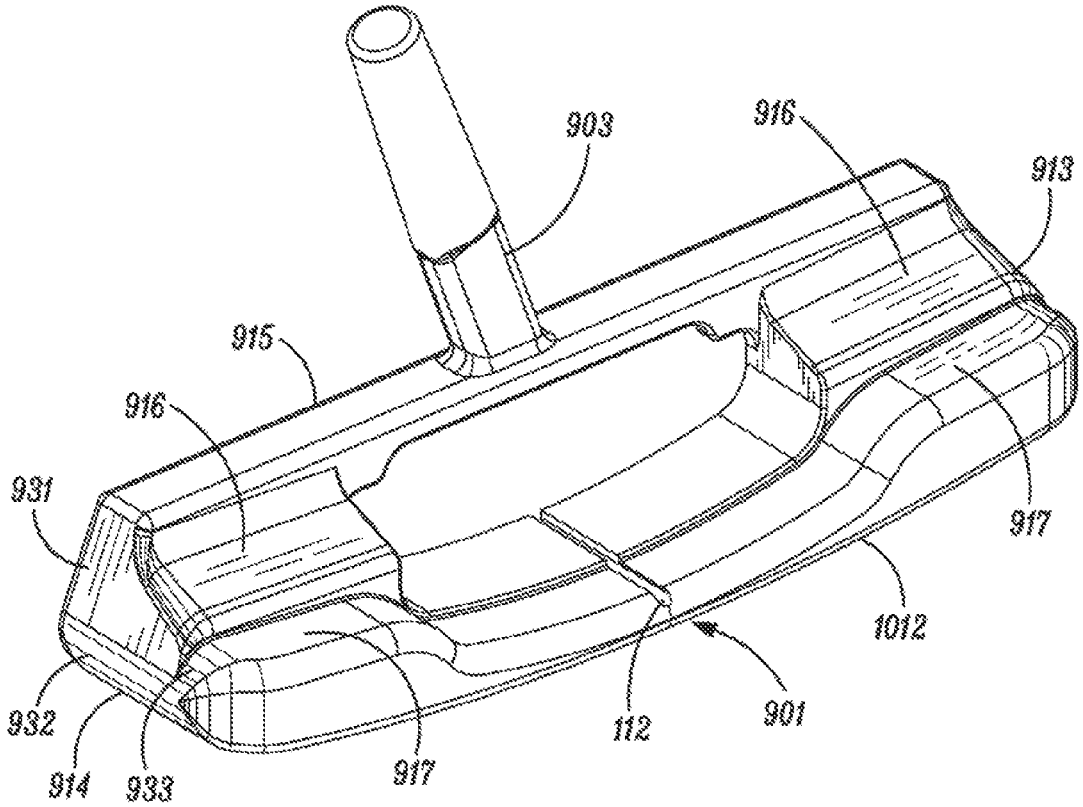
FIG. 10 illustrates a back, top, heel-side view of a golf club head body of the golf club of FIG. 9, according to the third embodiment.
Figure 14:
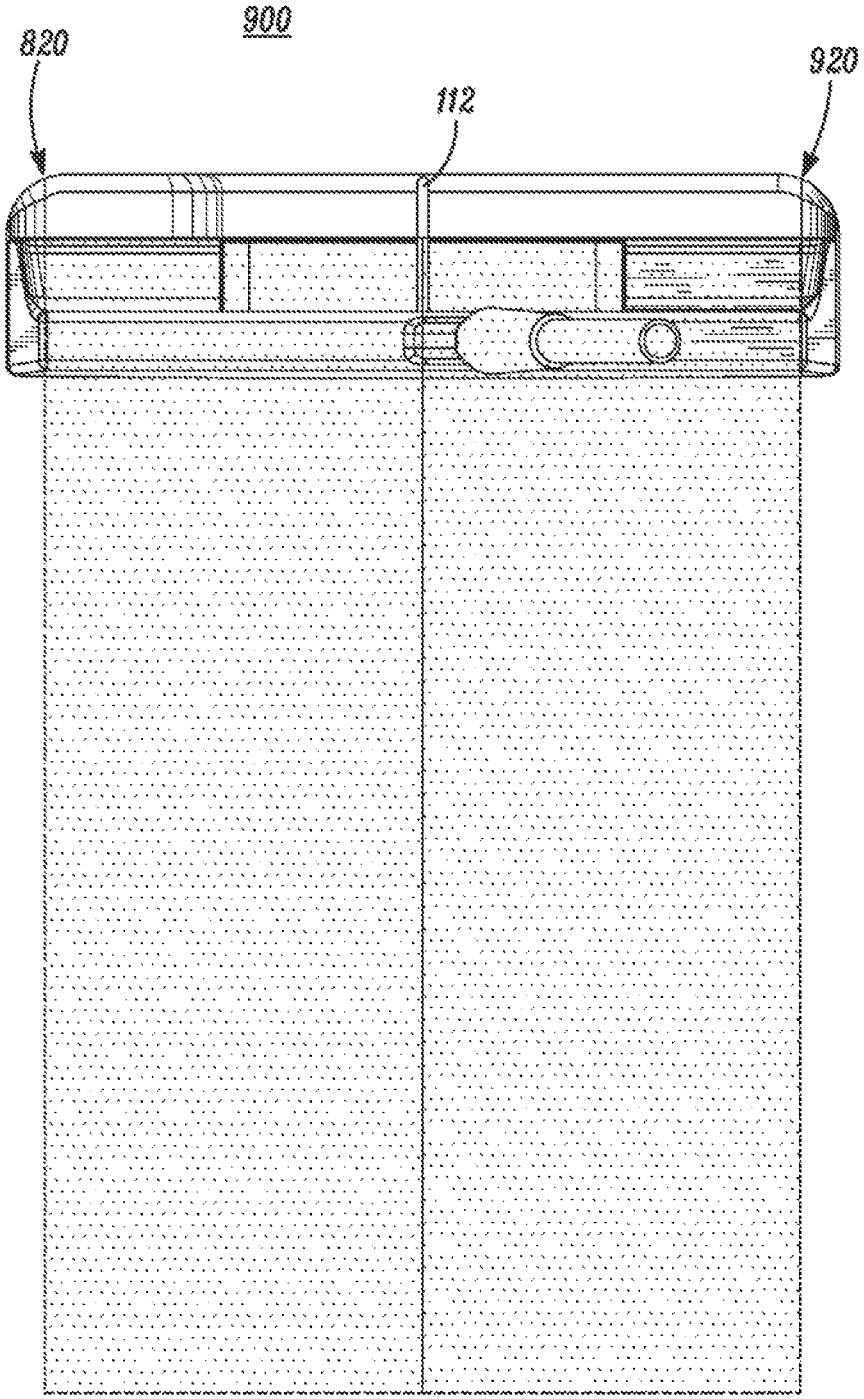
FIG. 14 illustrates an annotated top view of the golf club of FIG. 9, according to the third embodiment.

Turning to another embodiment, FIG. 9 illustrates a top view of a golf club 900, according to a third embodiment. FIG. 10 illustrates a back, top, heel edge view of a golf club head body 901 of golf club 900, according to the third embodiment. FIG. 14 illustrates an annotated top view of golf club 900, according to the third embodiment. Golf club 900 is merely exemplary and is not limited to the embodiments presented herein. Golf club 900 can be employed in many different embodiments or examples not specifically depicted or described herein. In this embodiment, the golf club 900 can be similar to golf club 100 (FIGS. 1, 3-5, and 7) and golf club 800 (FIG. 8), except that golf club 900 can have a variable radius of curvature at toe edge 913 and heel edge 914 similar to the variable radius of curvature of toe edge 113 of golf club head body 101 of FIGS. 1, 3-5, 7, and 12 and the variable radius of curvature of heel edge 814 of golf club head body 801 of FIGS. 8 and 13, respectively.

Golf club 900 can be an iron-type golf club head, such as a 1-iron, a 2-iron, a 3-iron, a 4-iron, a 5-iron, a 6-iron, a 7-iron, an 8-iron, a 9-iron, a sand wedge, a lob wedge, a pitching wedge, an n-degree wedge (e.g., 44 degrees (°), 48°, 52°, 56°, 60°, etc.), etc. In a different embodiment, golf club 900 can also be a wood-type golf club, a hybrid-type golf club, or a putter-type golf club.

In some embodiments, a golf club 900 can include: (a) golf club head body 901; (b) a shaft 902; and (c) a hosel 903 coupled to shaft 902. In a different embodiment, golf club 900 has a hole, instead of hosel 903, to which shaft 902 is coupled. A first end of shaft 902 and hosel 903 may be secured to each other by an adhesive bonding process (e.g., epoxy) and/or other suitable bonding processes (e.g., mechanical bonding, soldering, welding, and/or brazing). To complete the golf putter, a grip (not shown) may receive a second or opposite end of the shaft. The shaft and the grip may be secured to each other by an adhesive bonding process and/or other suitable bonding processes. In a different embodiment, golf club 900 has a hole, instead of hosel 903, to which shaft 902 is coupled. Hosel 903 or the hole can be at the heel end or the center portion of the golf club head body 901.

Golf club head body 901 includes; (a) a face member 911 (i.e., a strike surface) arranged for impacting a golf ball 590 (FIG. 5); (b) a sole 1012 (FIG. 10) coupled to face member 911; (c) a toe edge 913 coupled to face member 911 and sole 1012; (d) a heel edge 914 opposite toe edge 913 and coupled to face member 911 and the sole; (e) a first surface 915 coupled to heel edge 914 at a boundary 920 and coupled to toe edge 913 at a boundary 940; (f) a second surface 916 coupled to heel edge 914 at boundary 920 and coupled to toe edge 913 at a boundary 940; (g) a third surface 917 coupled to heel edge 914 at boundary 920 and coupled to toe edge 913 at a boundary 940. In some embodiments, one or more first surface 915, second surface 916, and third surface 917 can have ridges.

In some examples, first surface 915 can be coupled to heel edge 914 at a first portion 931 of heel edge 914. Second surface 916 can be coupled to heel edge 914 at a second portion 932 of heel edge 914. Third surface 917 can be coupled to heel edge 914 at a third portion 933 of heel edge 914. First portion 931, second portion 932, and third portion 933 can be part of or form boundary 920.

In many examples, heel edge 914 can have a variable radius of curvature such that boundary 920 (and/or first portion 931, second portion 932, and/or third portion 933) forms a first alignment aid for the person using golf club 900. In some embodiments, a radius of curvature of heel edge 914 varies in second portion 932 such that boundary 920 (and/or first portion 931, second portion 932, and/or third portion 933) forms the first alignment aid. For example, as shown in FIG. 9, boundary 920 can be substantially perpendicular to face member 911. In the same or different embodiments, boundary 920 can be a sheen line of golf club head body 901. First portion 931, second portion 932, and third portion 933 can be similar to first portion 131, second portion 132, and third portion 133, respectively, in FIG. 1. Accordingly, boundary 920 can be similar to boundary 120 (FIG. 1) and/or boundary 820 (FIG. 8).

In the same or different examples, first surface 915 can be coupled to toe edge 913 at a first portion 941 of toe edge 913. Second surface 916 can be coupled to toe edge 913 at a second portion 942 of toe edge 913. Third surface 917 can be coupled to toe edge 913 at a third portion 943 of toe edge 913. First portion 941, second portion 942, and third portion 943 can be part of or form boundary 940.

Similar to heel edge 914, toe edge 913 can have a variable radius of curvature such that boundary 940 (and/or first portion 941, second portion 942, and/or third portion 943) forms a second alignment aid for the person using the golf club. In some embodiments, a radius of curvature of toe edge 913 varies in second portion 942 such that boundary 940 (and/or first portion 941, second portion 942, and/or third portion 943) forms the second alignment aid for the person using the golf club. For example, as shown in FIG. 9, boundary 940 can be substantially perpendicular to face member 911. In the same or different embodiments, boundary 940 can be a sheen line of golf club head body 901. As indicated previously, first portion 931, second portion 932, and third portion 933 can be similar to first portion 131, second portion 132, and third portion 133, respectively, in FIG. 1. Accordingly, boundary 940 can be similar to boundary 120 (FIG. 1).

Using a variable radius of curvature at toe edge 913 and heel edge 914 allows the golf club manufacturer to make toe edge 913 and heel edge 914 substantially perpendicular, or appear to be substantially perpendicular, to face member 911, instead of being skewed at an angle. FIG. 14 illustrates the visual impression created by alignment mark 112 and boundaries 920 and 940. The variable radius of curvature of toe edge 913 and heel edge 914 create lines that are substantially parallel to the proper alignment of golf club 900 and golf ball 590 (FIG. 5) and that is substantially perpendicular to face member 911. In many embodiments, lines created by boundaries 920 and 940 are parallel with alignment mark 112 and cumulatively create a visual impression for the golf club user of the proper alignment of golf club 900. Thus, the variable radius of curvature of toe edge 913 and heel edge 914 helps in the alignment of golf club 900 and golf ball 590 (FIG. 5) with the desired path of golf ball 590 (FIG. 5). Moreover, in some examples, boundaries 920 and 940 are substantially perpendicular to face member 911, and their perpendicular nature is apparent to the user of golf club 900 because golf ball 590 (FIG. 5) will take a substantially perpendicular path to face member 911 when golf ball 590 (FIG. 5) is properly struck.

Figure 15:
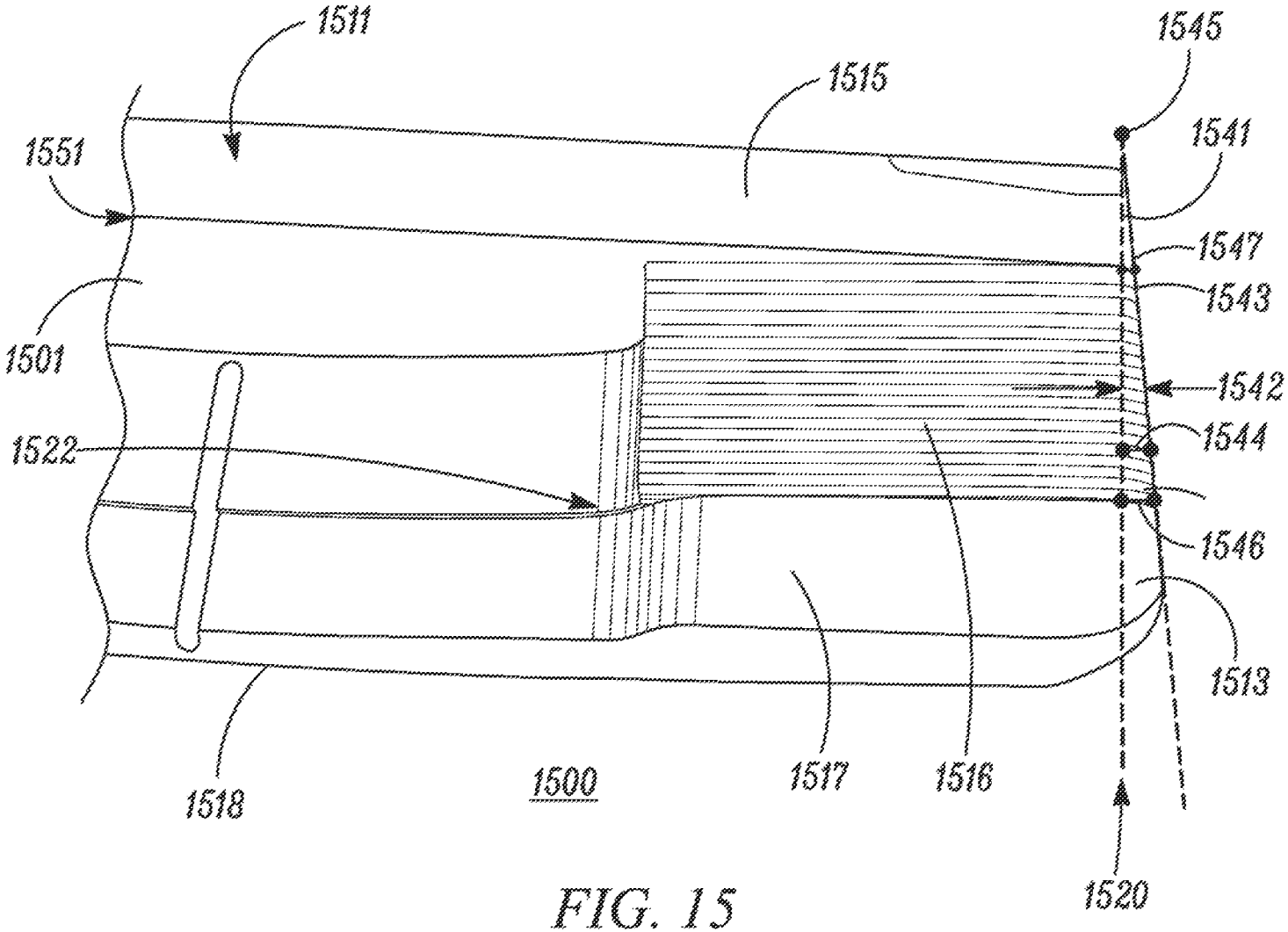
FIG. 15 illustrates an annotated top view of part of a golf club, according to a fourth embodiment.
Figure 16:
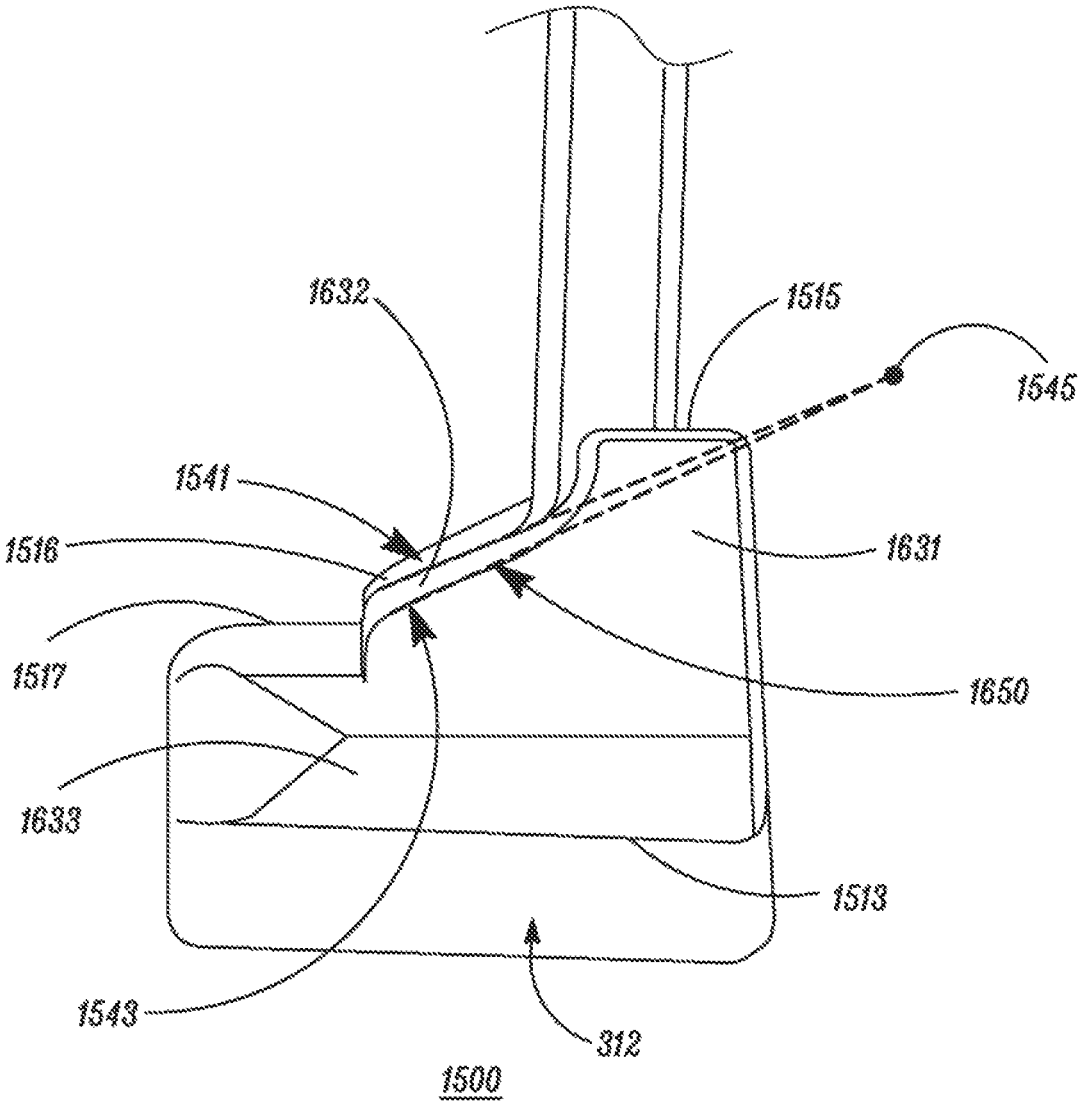
FIG. 16 illustrates an annotated top, isometric, toe-side view of the golf club of FIG. 15, according to the fourth embodiment.
Figure 17:
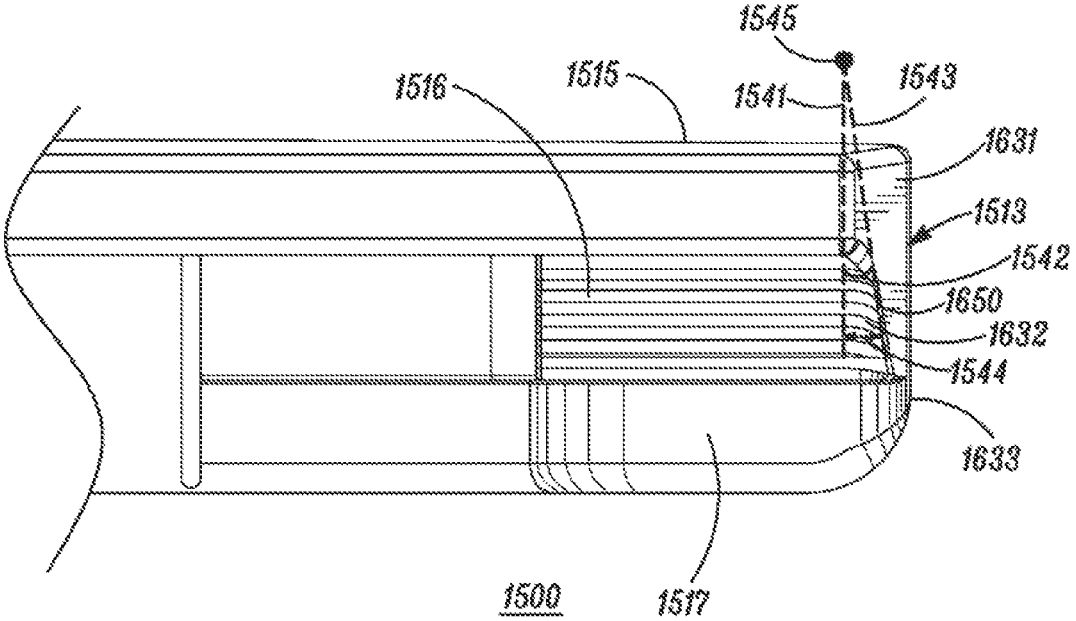
FIG. 17 illustrates another annotated top, isometric, toe-side view of part of the golf club of FIG. 15, according to the fourth embodiment.

Turning to still another embodiment, FIG. 15 illustrates an annotated top, toe-side view of part of a golf club 1500, according to a fourth embodiment. FIG. 16 illustrates an annotated, top, isometric, toe-side view of golf club 1500, according to the fourth embodiment. FIG. 17 illustrates another annotated, top, isometric, toe-side view of golf club 1500, according to the fourth embodiment. Golf club 1500 is merely exemplary and is not limited to the embodiments presented herein. Golf club 1500 can be employed in many different embodiments or examples not specifically depicted or described herein.

Golf club 1500 can be an iron-type golf club head, such as a 1-iron, a 2-iron, a 3-iron, a 4-iron, a 5-iron, a 6-iron, a 7-iron, an 8-iron, a 9-iron, a sand wedge, a lob wedge, a pitching wedge, an n-degree wedge (e.g., 44 degrees (°), 48°, 52°, 56°, 60°, etc.), etc. In a different embodiment, golf club 1500 can also be a wood-type golf club, a hybrid-type golf club, or a putter-type golf club.

In some embodiments, golf club 1500 can include: (a) golf club head body 1501; (b) a shaft 102 (FIG. 16); and (c) a hosel 103 (FIG. 16) coupled to shaft 102 (FIG. 16). In a different embodiment, golf club 1500 has a hole, instead of hosel 103, to which shaft 102 is coupled. To complete the golf club, a grip (not shown) may receive a second or opposite end of the shaft. Hosel 103 or the hole can be at the heel end or the center portion of the golf club head body 1501.

Golf club head body 1501 includes: (a) a face member 1511 (i.e., a strike surface) arranged for impacting a golf ball 590 (FIG. 5); (b) a sole 312 (FIG. 16) coupled to face member 1511; (c) a toe edge 1513 coupled to face member 1511 and sole 312; (d) a heel edge opposite toe edge 1513 and coupled to face member 1511 and sole 312; (e) a first surface 1515 coupled to toe edge 1513 at a boundary 1520; (f) a second surface 1516 coupled to toe edge 1513 at boundary 1520; (g) a third surface 1517 coupled to toe edge 1513 at boundary 1520. First surface 1515 can be coupled to second surface 1516 at boundary 1551. Second surface 1516 can be coupled to third surface 1517 at boundary 1552. In many examples, golf club head body 1501 can be similar or substantially the same as golf club head body 101 (FIG. 1).

Turning to FIG. 16, in various embodiments, first surface 1515 can be coupled to toe edge 1513 at a first portion 1631 of toe edge 1513. Second surface 1516 can be coupled to toe edge 1513 at a second portion 1632 of toe edge 1513. Third surface 1517 can be coupled to toe edge 1513 at a third portion 1633 of toe edge 1513. First portion 1631, second portion 1632, and third portion 1633 can be part of or form boundary 1520 (FIG. 15). In some examples, a boundary 1650 can form a boundary between first portion 1631 and second portion 1632. In various embodiments, the outer boundaries of second portion 1632 can form a trapezoidal shape.

This embodiment will describe a mathematical relationship between some parts of golf club head body 1501. Specifically, mathematical relationships exist between lengths of some of the boundaries of second portion 1632. Before the specific mathematical relationship can be discussed, a few additional items related to golf club head body 1501 need to be defined.

Figure 18:
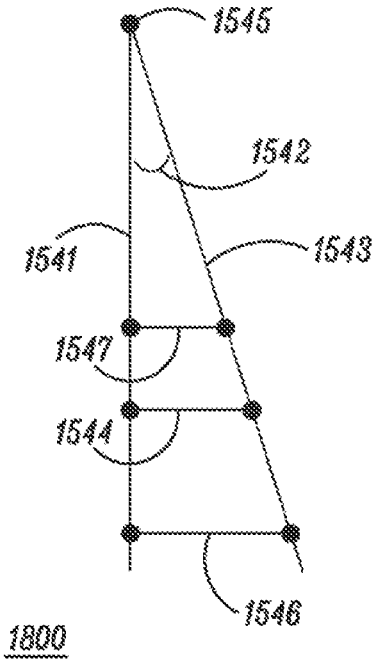
FIG. 18 illustrates an example of an alignment plane and various projections of parts of golf club head body of FIG. 15 into the alignment plane 18.

In various embodiments, an alignment plane 1800 (FIG. 18) can be defined to be substantially parallel to a ground plane and/or surface 1515 and normal to face member 1511. FIG. 18 illustrates an example of an alignment plane 1800 and various projections of parts of golf club head body 1501 into alignment plane 1800. A projection 1543 can be a projection of boundary 1650 downward into alignment plane 1800. Similarly, projection 1541 can be a projection downward into alignment plane 1800 of boundary 1520.

Projection 1543 can intersect projection 1541 at an intersection point 1545 (projected or actual) to form an angle 1542. Intersection point 1545 can be near face member 1511 within golf club head body 1501. In other examples (not shown), intersection point 1545 can be near rear surface 1518 (FIG. 15) within golf club head body 1501. In the same or different examples, intersection point 1545 can be a projection outside of golf club head body 1501.

In the same or different example, a line can be used to couple boundary 1520 to boundary 1650 (FIG. 16). Projection 1544 (FIG. 15) can be a projection downward into alignment plane 1800 of the line coupling boundary 1520 to boundary 1650. Projections 1541, 1543, and 1544 can form a triangle.

In various embodiments, the relationship between a length of projection 1541 ("a"), a length of projection 1543 ("d"), a length of projection 1544 ("r") (measured from intersection point 1545), and angle 1542 (angle "θ") is:

$$r=d*\sin(\theta) \quad (1)$$

$$r=a*\tan(\theta) \quad (2)$$

In one example, the length of projection 1541 ("a") is equal to approximately 1.88 millimeters (mm); the length of projection 1543 ("d") is equal to approximately 1.91 mm; the length of projection 1544 ("r") is equal to approximately 0.28 mm; and angle 1542 (angle "θ") is approximately 8.5 degrees (°).

A projection 1547 can be a projection downward into alignment plane 1800 of a line coupling boundary 1520 to boundary 1650 (FIG. 16) at boundary 1551. In some examples, a length of projection 1547 can be used for length "r," instead of the length of projection 1544 in equations (1) and (2). Similarly, a length of any projection coupling projection 1541 to projection 1543 can be used as length "r" above, and equations (1) and (2) will be satisfied.

In the same or different embodiment, a projection 1546 can be a projection downward into alignment plane 1800 of a line coupling boundary 1520 to boundary 1650 (FIG. 16) at boundary 1552. In some examples, a length of projection 1546 can be used for length "r," instead of the length of projection 1544 in equations (1) and (2). In same example, the length of projection 1546 can be 2.8 mm and the length of projection 1547 can be 1.5 mm.

In numerous examples, a portion of projection 1541, a portion of projection 1543, projection 1546, and projection 1547 can define a periphery of a projection downward into alignment plane 1800 of second portion 1632 (FIG. 16).

In the example shown in FIGS. 15-17, parts of the toe portion of golf club 1500 have the relationships described above. In other examples, instead of the toe portion of the golf club having the relationships described above, parts of the heel portion of the golf club (e.g., the heel portion of golf club 800 or 900 of FIG. 8 or 9, respectively) can have the mathematical relationships describe above in equations (1) and (2). In further examples, parts of the heel portion and parts of the toe portion can both have the mathematical relationships described above in equations (1) and (2). In some examples, parts of golf clubs 100, 800, and/or 900 of FIGS. 1, 8, and 9 can have the mathematical relationships described above in equations (1) and (2).

Figure 19:
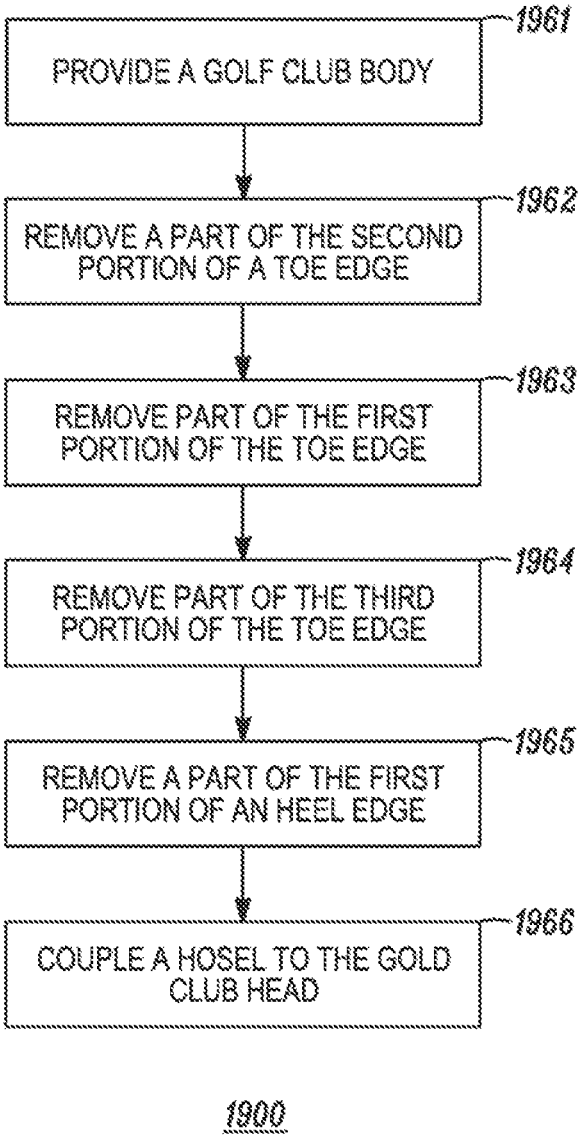
FIG. 19 illustrates a flow chart for an embodiment of a method of manufacturing a golf club.

FIG. 19 illustrates a flow chart for an embodiment of a method 1900 of manufacturing a golf club. Method 1900 is merely exemplary and is not limited to the embodiments presented herein. Method 1900 can be employed in many different embodiments or examples not specifically depicted or described herein. In some embodiments, the activities, the procedures, and/or the processes of method 1900 can be performed in the order presented. In other embodiments, the activities, the procedures, and/or the processes of the method 1900 can be performed in any other suitable order. In still other embodiments, one or more of the activities, the procedures, and/or the processes in method 1900 can be combined or skipped.

Referring to FIG. 19, method 1900 includes an activity 1961 of providing a golf club head body. For example, the golf club head body can be similar or identical to golf club head body 101, 801, 901, or 1501 of FIGS. 1, 8, 9, and 15, respectively. For example, the golf club head body may be formed, for instance, by casting, forging, cutting, grinding, machining, welding, a combination thereof, or the like.

In some embodiments, the golf club body, when completed or after activity 1961 can having a face member, a sole, a toe edge coupled to the face member and the sole, a heel edge coupled to the face member and sole and opposite the toe edge, a first surface coupled to a first portion of the toe edge, a second surface coupled to a second portion the toe edge, and a third surface coupled to a third portion of the toe edge.

Method 1900 in FIG. 19 continues with an activity 1962 of removing a part of the second portion of the toe edge. In some examples, the second portion of the toe edge is removed such that a radius of curvature of the toe edge varies in the second portion such that the first portion, the second portion, and/or third portion can form a first alignment aid for the person using the golf club. For example, the part of the second portion of the toe edge can be removed by cutting or grinding the toe edge of the golf club head body. In a different embodiment, the part of the second portion of the toe edge can be removed as part of a casting process. In this different embodiment, activities 1961 and 1962 can be performed simultaneously with each other.

In many examples, removing the part of the second portion of the toe edge involves removing the part of the second portion of the toe edge such that the first portion, the second portion form, and/or the third portion form a first alignment aid that is substantially perpendicular to the face member In some examples, part of the second portion of the toe edge can be removed such that the second portion of the toe edge is similar or the same as second portion 132 of toe edge 113 of FIG. 1 or second portion 942 of toe edge 913 of FIG. 9.

Subsequently, method 1900 of FIG. 19 includes an activity 1963 of removing part of the first portion of the toe edge. In some examples, the first portion of the toe edge is removed such that the first portion and the second portion form the first alignment aid. For example, the part of the first portion of the toe edge can be removed by cutting or grinding the toe edge of the golf club head body. In other embodiments, the part of the first portion of the toe edge can be removed as part of a casting process, in which case activities 1961 and 1963 (and possibly activity 1962) can be performed simultaneously with each other. In some examples, after removing the part of the first portion of the toe edge, the radius of curvature at the first portion is constant. In other examples, the radius of curvature at the first portion is variable.

In some examples, parts of the first portion and the second portion are removed. In some examples, the part of the first portion and the part of the first portion are removed concurrently or sequentially. In other examples, only a part of the second portion of the toe edge is removed, and activity 1963 is skipped.

In some examples, parts of the first portion and the second portion are removed such that the relationship between the first portion and the second portion satisfy equations (1) and (2).

Next, method 1900 of FIG. 19 includes an activity 1964 of removing part of a third portion of the toe edge. In some examples, the part of the third portion of the toe edge is removed such that the first portion, the second portion, and the third portion form the first alignment aid. For example, the part of the third portion of the toe edge can be removed by cutting or grinding the toe edge of the golf club head body. In other embodiments, the part of the third portion of the toe edge can be removed as part of a casting process, in which case activities 1961 and 1964 (and possibly activity 1962 and/or 1963) can be performed simultaneously with each other. In some examples, after removing the part of the third portion, the radius of curvature of the toe edge at the third portion is constant. In other examples, the radius of curvature of the toe portion at the third portion is variable.

In some examples, the parts of the first portion, the second portion, and/or the third portion are removed to form the first alignment aid. In some examples, the part of the first portion, the part of the second portion and/or the part of the third portion are removed concurrently or sequentially. In other examples, the part of the third portion of the toe edge is not removed, and activity 1964 is skipped.

Method 1900 in FIG. 19 continues with an activity 1965 of removing a part of a first portion of a heel edge of the golf club body such that a second alignment aid for the person using the golf club is formed. For example, the part of the first portion of the heel edge of the golf club body can be removed by cutting or grinding the heel edge of the golf club head body. In other embodiment, the part of the first portion of the heel edge of the golf club body can be removed as part of a casting process, in which case activities 1961 and 1965 (and possibly activity 1962, 1963, and 1964) can be performed simultaneously with each other.

In some examples, the part of the first portion of the heel edge can be removed such that the first portion of the heel edge is similar to or the same as second portion 832 of heel edge 814 of FIG. 8 or second portion 932 of heel edge 914 of FIG. 9. In the same or different embodiments, parts of the heel edge adjacent to the first surface and the third surface can also be removed. The removal of the part of the heel edge adjacent to the first surface and the third surface can be similar or identical to activities 1963 and 1964, respectively. When not performed simultaneously with each other, activities 1962, 1963, 1964, and 1965 can be performed in any sequence.

Subsequently, method 1900 of FIG. 19 includes an activity 1966 of coupling a hosel to the golf club head, wherein the hosel is configured to accept a shaft. In some examples, the hosel can be coupled to the golf club head body such that the golf club is similar or identical to golf club 100, 800, 900, or 1500 of FIGS. 1, 8, 9, and 15, respectively.

While FIGS. 1, 3-5, 7-9, and 12-17 may depict an Anser® golf putter head (manufactured by Karsten Manufacturing Inc., of Phoenix, Ariz.), the methods, apparatus, and articles of manufacture described herein may be readily applicable to other suitable types of golf putter heads or other type of golf clubs. For example, the methods, apparatus, and articles of manufacture described herein may be applicable to mallet putters, blade putters, and other types of putters. The methods, apparatus, and articles of manufacture described herein are not limited this regard. Accordingly, the disclosure of embodiments is intended to be illustrative of the scope of the present disclosure and is not intended to be limiting. It is intended that the scope of the present disclosure shall be limited only to the extent required by the appended claims.

As the rules to golf may change from time to time (e.g., new regulations may be adopted or old rules may be eliminated or modified by golf standard organizations and/or governing bodies), golf equipment related to the methods, apparatus, and/or articles of manufacture described herein may be conforming or non-conforming to the rules of golf at any particular time. Accordingly, golf equipment related to the methods, apparatus, and/or articles of manufacture described herein may be advertised, offered for sale, and/or sold as conforming or non-conforming golf equipment. The methods, apparatus, and/or articles of manufacture described herein are not limited in this regard.

As explained previously, while the above examples may be described in connection with a putter-type golf club, the apparatus, methods, and articles of manufacture described herein may be applicable to other types of golf club such as a fairway wood-type golf club, a hybrid-type golf club, an iron-type golf club, a wedge-type golf club, or a driver-type golf club. In other embodiments, the apparatus, methods, and articles of manufacture described herein may be applicable other type of sports equipment such as a hockey stick, a tennis racket, a fishing pole, a ski pole, etc.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club comprising:

a golf club head body comprising:

a face surface arranged for impacting a golf ball;

a rear surface opposite the face surface;

a sole surface;

a crown surface comprising a first crown surface and a second crown surface, the first crown surface being closer to the face surface than the second crown surface; and a heel surface comprising a first heel surface and a second heel surface, the first heel surface being closer to the face surface than the second heel surface;

wherein:

the heel surface is permanently coupled to the crown surface, the face surface and the sole surface;

the crown surface is located opposite the sole surface;

the heel surface transitions to the crown surface at a heel end boundary surface comprising a first curved boundary surface where the first heel surface transitions to the first crown surface, a second curved boundary surface where the second heel surface transitions to the second crown surface, and a heel end radius of curvature;

the first curved boundary surface comprises a first radius of curvature approximately parallel to the face surface and the second curved boundary surface comprises a second radius of curvature approximately parallel to the face surface, the heel end radius of curvature comprising the first radius of curvature and the second radius of curvature;

the crown surface interfaces with the heel end curved boundary surface at a first boundary line;

and the second radius of curvature varies such that the first boundary line extends substantially perpendicular to the face surface to form a first alignment aid for the golf club.

2. The golf club of claim 1, wherein:

the second radius of curvature varies continuously between the face surface and the rear surface; and the first radius of curvature remains constant.

3. The golf club of claim 1, wherein:

when the golf club head body is at the address positioned, the first crown surface is substantially parallel to a ground plan.

4. The golf club of claim 1, wherein:

the second crown surface comprises a second boundary line and a third boundary line opposite the second boundary line;

the second boundary line is closer to the first crown surface than is the third boundary line; and the second boundary line is farther from a ground plane than is the third boundary line.

5. The golf club of claim 4, wherein:

the second boundary line is aligned askew with the first boundary line in a plane parallel to the ground plane.

6. The golf club of claim 1, wherein:

the crown surface further comprises a third crown surface, the second crown surface being closer to the face surface than is the third crown surface;

the heel surface comprises a third heel surface, the second heel surface being closer to the face surface than is the third heel surface;

the heel end curved boundary surface comprises a third curved boundary surface where the third heel surface transitioned to the third crown surface;

the third curved boundary surface comprises a third radius of curvature approximately parallel to the face surface, the heel end radius of curvature comprising the third radius of curvature;

the third crown surface is closer to a ground plane than is the second crown surface; and the first radius of curvature and the third radius of curvature are different from at least part of the second radius of curvature.

7. The golf club of claim 1, wherein:

the golf club head body is a unitary body.

8. The golf club of claim 1, further comprising:

one or more ridges on the first crown surface of the golf club head body.

9. The golf club of claim 1, further comprising:

a hosel at a heel end of the golf club head.

10. A golf club comprising:

a golf club head body comprising:

a face surface arranged for impacting a golf ball;

a rear surface opposite the face surface;

a sole surface;

a crown surface comprising a first crown surface and a second crown surface, the first crown surface being closer to the face surface than the second crown surface; and the second crown surface includes one or more ridges;

a heel surface comprising a first heel surface and a second heel surface, the first heel surface being closer to the face surface than the second heel surface;

wherein:

the heel surface is permanently coupled to the crown surface, the face surface and the sole surface;

the crown surface is located opposite the sole surface;

the heel surface transitions to the crown surface at a heel end boundary surface comprising a first curved boundary surface where the first heel surface transitions to the first crown surface, a second curved boundary surface where the second heel surface transitions to the second crown surface, and a heel end radius of curvature;

the first curved boundary surface comprises a first radius of curvature approximately parallel to the face surface and the second curved boundary surface comprises a second radius of curvature approximately parallel to the face surface, the heel end radius of curvature comprising the first radius of curvature and the second radius of curvature;

the crown surface interfaces with the heel end curved boundary surface at a first boundary line;

and the second radius of curvature varies such that the first boundary line extends substantially perpendicular to the face surface to form a first alignment aid for the golf club.

11. The golf club of claim 10, wherein:

the second radius of curvature varies continuously between the face surface and the rear surface; and the first radius of curvature remains constant.

12. The golf club of claim 10, wherein:

when the golf club head body is at an address position, the first crown surface is substantially parallel to a ground plane.

13. The golf club of claim 10, wherein:

when the golf club head body is at an address position, the first crown surface is farther from a ground plane than is the second crown surface.

14. The golf club of claim 10, wherein:

the second crown surface comprises a second boundary line and a third boundary line opposite the second boundary line;

the second boundary line is closer to the first crown surface than is the third boundary line; and the second boundary line is farther from a ground plane than is the third boundary line.

15. The golf club of claim 14, wherein:

the second boundary line is aligned askew with the first boundary line in a plane parallel to the ground plane.

16. The golf club of claim 10, wherein:

the crown surface further comprises a third crown surface, the second crown surface being closer to the face surface than is the third crown surface;

the heel surface comprises a third heel surface, the second heel surface being closer to the face surface than is the third heel surface;

the heel end curved boundary surface comprises a third curved boundary surface where the third heel surface transitions to the third crown surface;

the third curved boundary surface comprises a third radius of curvature approximately parallel to the face surface, the heel end radius of curvature comprising the third radius of curvature;

the third crown surface is closer to a ground plane than is the second crown surface; and the first radius of curvature and the third radius of curvature are different from at least part of the second radius of curvature.

17. The golf club of claim 16, further comprising:

one or more ridges on the third crown surface of the golf club head body.

18. The golf club of claim 10, wherein:

the one or more ridges of the second crown surface changes an angle of reflection of light hitting the second crown surface.

19. The golf club of claim 10, further comprising:

one or more ridges on the first crown surface of the golf club head body.

20. The golf club of claim 10, wherein:

the golf club head body is a unitary body.

* * * * *